United States Patent [19]

Kurtz

[11] Patent Number: 4,733,616

[45] Date of Patent: Mar. 29, 1988

[54] TRACK-BOUND SELFPROPELLED CAR CONVEYOR

[75] Inventor: Roland Kurtz, Frankfurt am Main, Fed. Rep. of Germany

[73] Assignee: Buro Patent AG, Glarus, Switzerland

[21] Appl. No.: 826,135

[22] Filed: Feb. 4, 1986

[30] Foreign Application Priority Data

Feb. 12, 1985 [CH] Switzerland ..... 632/85

[51] Int. Cl.[4] ..... B65G 35/00

[52] U.S. Cl. ..... 104/296; 104/288; 104/88; 414/273; 191/3

[58] Field of Search ..... 104/88, 288, 295–297; 414/411, 273; 198/349, 350, 355; 292/201; 180/281; 105/341; 191/3

[56] References Cited

U.S. PATENT DOCUMENTS

| | | | |
|---|---|---|---|
| 3,823,673 | 7/1974 | Wesener | 104/288 X |
| 4,056,063 | 11/1977 | Ritter | 104/88 |
| 4,200,167 | 4/1980 | Cockman, Jr. | 180/281 |
| 4,470,625 | 9/1984 | Walsh et al. | 292/201 |
| 4,554,873 | 11/1985 | Rex | 104/88 |
| 4,605,102 | 8/1986 | Morano et al. | 104/29 |

FOREIGN PATENT DOCUMENTS

| | | | |
|---|---|---|---|
| 2309316 | 8/1974 | Fed. Rep. of Germany | 104/288 |
| 2454373 | 5/1976 | Fed. Rep. of Germany | 104/302 |
| 2935969 | 3/1981 | Fed. Rep. of Germany . | |
| 3313951 | 10/1984 | Fed. Rep. of Germany . | |

*Primary Examiner*—David A. Scherbel
*Assistant Examiner*—Russell D. Stormer
*Attorney, Agent, or Firm*—Karl F. Ross; Herbert Dubno

[57] ABSTRACT

My conveyor comprises an associated track-bound car including a drive motor supplied with drive current by current-carrying rails, a container, and a cover for the conveyor, as well as a track on which the conveyor runs by a plurality of stations. In order to prevent unauthorized opening of the cover a latch of a locking mechanism mounted in the track-bound car is restrained in a locked configuration. The latch can be unlocked by an electromagnetic unlocking mechanism mounted in the track-bound car. A very simple control of the unlocking mechanism can be provided, when, at a position or station in the conveyor where it is to be unlocked, an unlocking signal generator is present, which is automatically connectable with the track-bound car, in order to supply the unlocking mechanism with a required unlocking current.

10 Claims, 4 Drawing Figures

TRACK-BOUND SELFPROPELLED CAR CONVEYOR

FIELD OF THE INVENTION

My invention relates to a conveyor with track-bound selfpropelled cars which transports cargo, e.g. articles in a container formed by the car, between a plurality of stations.

BACKGROUND OF THE INVENTION

A conveyor can comprise a track-bound car which is selfpropelled. A drive motor for the track-bound car can be supplied with a drive current by current-carrying rails, and a container on the track-bound car can be closable by means of a cover which can be locked by a latch of a locking mechanism containing at least one unlocking electromagnet.

A track-bound car of this type is described for example in German Patent document DE-OS No. 33 13 951. In this known conveyor, a stop code is provided at a generating station by a code setting mechanism. The electromagnetic unlocking mechanism affording access to the container remains idle and the container locked, until the control mechanism is given a correct code at a sensing station. The control mechanism then compares the code it is given with the locking code and operates the unlocking mechanism only when there is a coincidence between the codes. This arrangement for locking of the cover of the container is comparatively complicated and expensive, since at the generating station a mechanism for making and transmitting the lock code and a mechanism or circuit for operating and inputting the correct code at the sensing station are required. The track-bound car requires a comparatively complicated control mechanism, in order to compare the lock code with the validating code generated at the sensing station.

OBJECTS OF THE INVENTION

It is an object of my invention to provide an improved conveyor with associated track-bound car.

It is also an object of my invention to provide an improved conveyor with associated track-bound car, in which unlocking of the cover of the container is made possible with a simpler means than in prior art conveyors.

It is another object of my invention to provide an improved conveyor and associated track-bound car, in which a simpler control mechanism for providing a signal to unlock the container at a particular station is provided than in known conveyors.

SUMMARY OF THE INVENTION

These objects and others, which will become more readily apparent hereinafter, are attained in accordance with my invention in a conveyor comprising a track-bound car, a drive motor for the track-bound car supplied wtih a drive current by current-carrying rails and a container closable by means of a cover, wherein the cover is lockable by a latch of a locking mechanism containing at least one unlocking electromagnet.

According to my invention at a position or station in the conveyor for the track-bound car, at which the container is to be locked, an unloading signal generator is mounted, which is connectable electrically with the unlocking mechanism in the track-bound car, in order to supply an unlocking current for unlocking the container. Based on the basis of the latch of the locking mechanism into the locking position the cover once closed remains latched, until it reaches the position in the conveyor, where it is to be unlocked. At that point an unlocking current activates the unlocking mechanism. A satisfactory unlocking signal generator can be extraordinarily simple. The unlocking signal generator in its commonest form is a simple current source for the unlocking current, e.g. switching means, like a simple hand switch and/or switching means responding to code.

The conveyor according to my invention is characterized by an extraordinary simplicity which does not require a code setting mechanism for setting a lock code at a generating station or at a sending station a code setting mechanism for transmitting a validating code: furthermore no control mechanism for comparing the lock code with the validating code is required.

The conduction of the unlocking current to the station where the unlocking is to occur can occur in various ways.

Usually two current-carrying rails are used to supply the drive current to the drive motor, and brushes are mounted on the conveyor to contact these rails.

Then an additional current-carrying third rail can be provided with an associated brush, by which the unlocking current of the unlocking mechanism can be supplied from an unlocking signal generator.

In contrast to that approach the current-carrying rails used to supply drive current to the drive motor can also be used to directly control the unlocking mechanism, and no additional third current-carrying rail is required.

However in this case the voltage applied to the unlocking mechanism, of course with the drive current cut off, is substantially less than the voltage needed to be applied to the drive motor to produce the drive current; this prevents starting of the drive motor during unlocking. Voltage differences can be set in this case, in order to prevent travel of the conveyor during unlocking. Furthermore an additional stopping mechanism can be provided in the switching circuit of the drive motor, which prevents the activation of the drive motor, if the voltage applied thereto is less than the voltage necessary to produce the usual required drive current.

A particularly simple and economical switching circuit for control of the unlocking mechanism comprises a rectifier bridge, and a relay in series with a Zener diode, which are connected to the bridge, wherein the Zener diode is nonconducting for a voltage applied thereto of less than the voltage necessary to produce drive current in the drive motor, and the relay controls a second switch electrically connected with the unlocking mechanism.

In order to filter out short time voltage fluctuations of the drive current acting on the unlocking mechanism, the switching circuit includes a time delay circuitry device. This time delay unit also prevents activation of the electormagnet in the short time during fall-off of the drive current.

The stop mechanism for the drive current of the drive motor can be integrated into the unlocking mechanism circuitry. For example the relay has a first switch which disconnects the switching circuit of the drive motor.

Advantageously the unlocking signal generator has a code reading device responding to a station-specific code on the track-bound car. Thus the conveyor need not be stopped at every place there is a signal generator, and the unlocking signal generator is activated only when it receives the correct code.

Furthermore the locking mechanism is automatically activated on closing the cover, so that the closing of the cover is also possible with the unlocking current absent.

BRIEF DESCRIPTION OF THE DRAWING

The above and other objects, features, and advantages of my invention will become more readily apparent from the following description, reference being made to the accompanying drawing in which.

SPECIFIC DESCRIPTION

Figures 1, 2:
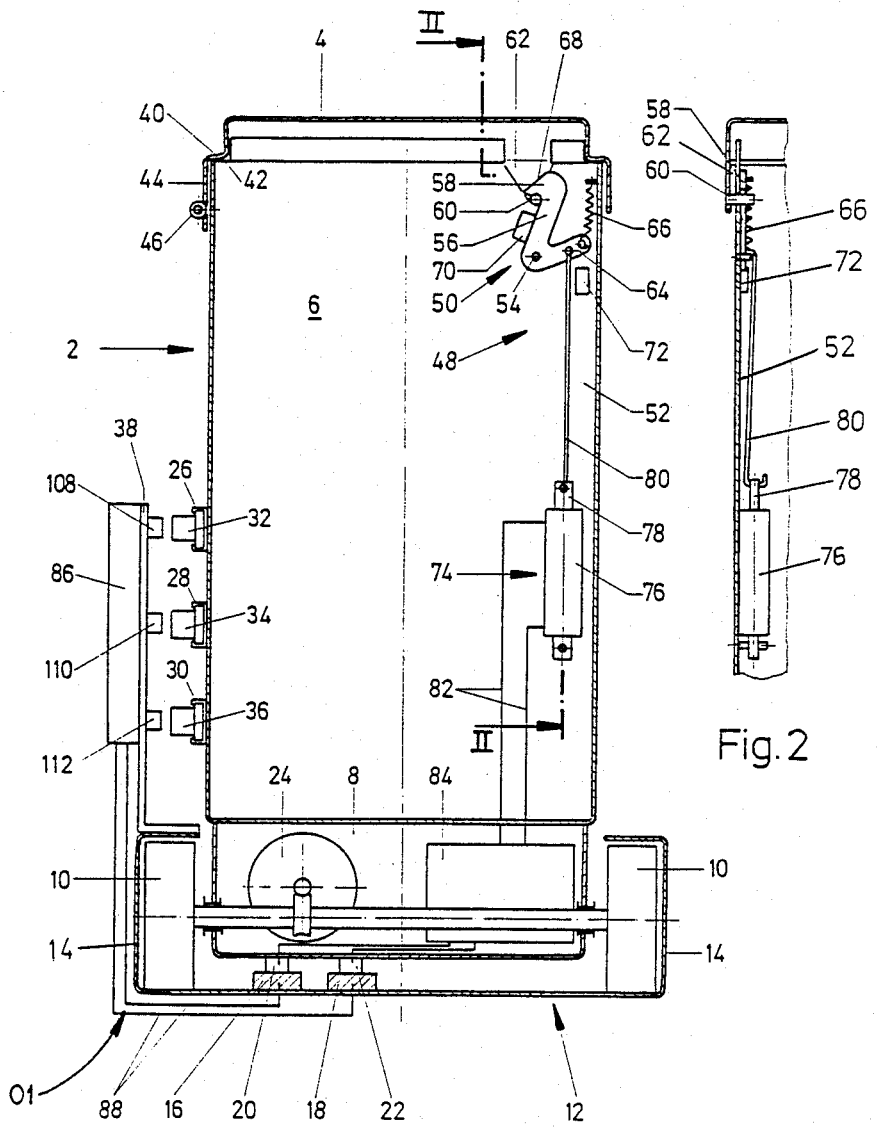
FIG. 1 is a vertical cross sectional view through a conveying mechanism and associated track-bound car according to my invention located at a station.
FIG. 2 is a sectional view of the locking mechanism from the track-bound car taken along line II—II of FIG. 1.

FIG. 1 shows a first embodiment of a conveyor and a track-bound car according to my invention. The track-bound car 2 comprises a container 6, a lockable cover 4 for closing the container 6, and an undercarriage 8, on which the container 6 is mounted detachably or undetachably.

It also comprises running or driving rollers 10, which run on the track 12 having lateral members 14, which engage the running rollers 10, so that the track-bound car 2 above them is held on the track 12.

On the track 12 first and second current-carrying rails 16 and 18 are mounted, which first and second brushes 20 and 22 contact, in order to supply the drive motor 24 with drive current.

On a side of the container 6 guide members 26, 28, and 30 are mounted positioned above each other longitudinally oriented in the direction of travel, on which code elements 32, 34, and 36 in the form of permanent magnets are mounted slidably. By means of code elements 33, 34, and 36 different codes can be set on the track-bound car 2, which can serve to indicate the destination, that is, the correct station at which the conveyor 2 is to stop, and other information.

A code when installed on the container 6 or elsewhere on the conveyor 2 can be read by a code reading device 38, which is mounted at each of the stations 01 or any station 01 along the course of the tracks and serves various purposes, for example control of switching, yielding or unlocking.

FIGS. 1 and 2 show that the cover 4 has a peripheral shoulder 40, with which it sits on the upper container edge 42 of the container 6. An apron 44 is attached to the outside of the shoulder 40, which engages the container 6.

On the side of the container 6, the cover 4 is connected pivotally to the container 6 by a hinged joint 46. On the opposite side of the container 6 an automatically locking mechanism 48 is mounted, which holds the cover 4 in the closed position and prevents unauthorized opening.

The lock mechanism 48 has a latch 50, which is supported pivotally on a first pin 54 connected to the wall 52 of the container 6. The latch 50 is constructed as a bent lever, wherein a first lever arm 56 has a catch 58, which engages a second pin 60 in the locked configuration. The second pin 60 is attached to the apron 44 of the cover 4 and projects through a hole 62 in the wall 52 of the container 6 into the interior of the container 6.

On the second lever arm 64 of the latch 50 a retaining tension spring 66 retains and holds the latch 50 in the locked configuration shown in FIG. 1.

The catch 58 has a slanting abutting surface 68, on which the first pin 60 of the cover 4 engages during closing of the cover 4 and the latch 50 is pushed back against the force of the retaining spring 66, so that the latch 50 is self-locking on closing the cover 4. The stops 70 and 72 act to limit the pivot motion of the latch 50.

An unlocking mechanism 74 also acts on the latch 50, and has an electromagnet 76, whose core 78 is pivotally attached by a coupling rod 80 with the second lever arm 64 of the latch 50.

The electromagnet 76 is connected by an electrical conductor 82 with a switching circuit 84, which is connected to the current-carrying rails 16 and 18 and serves first to activate the electromagnet 76 and additionally to cut-off the current flow for the drive motor 24,when a current flows to the unlocking mechanism 74.

To the current-carrying rails 16 and 18 a drive current flow for the drive motor 24 is provided from a current source not shown in detail, for example, with a voltage of 24 volts D.C.

For control of the unlocking mechanism 74 a fixed unlocking signal generator 86, which transmits an unlocking current to the current-carrying rails 16 and 18 by a conductor 88, is provided. The unlocking current is supplied at a voltage, which is less than the voltage associated with the drive current for the drive motor 24, for example 7 volts D.C.

Figure 3:
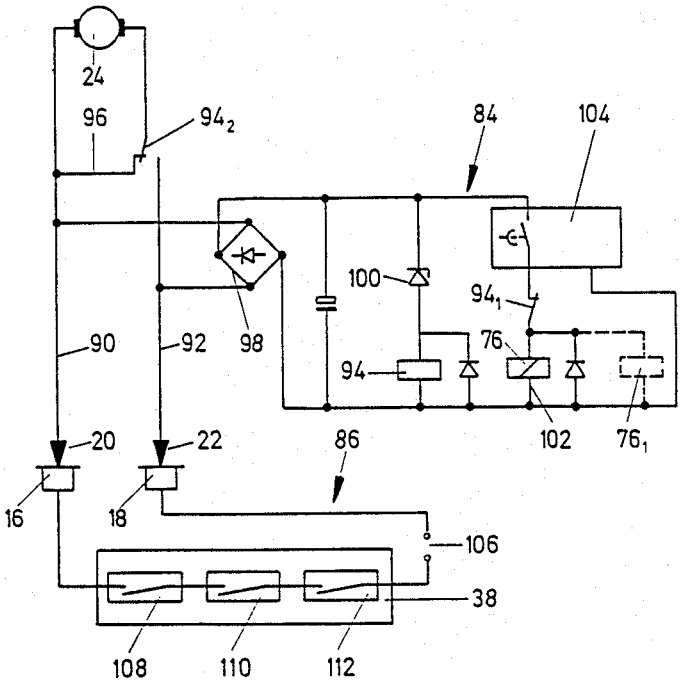
FIG. 3 is a schematic diagram of the electronic switching circuit for controlling the drive motor and the unlocking mechanism of the track-bound car of FIG. 1.

The structure of the switching circuit 84 serving to produce current for the unlocking mechanism 74 and for processing the drive current for the drive motor 24 is shown in detail in FIG. 3.

A first brush 20 is connected directly by electrical conductor 90 with the drive motor 24. A first switch $94_2$ controlled by a relay 94 is connected between the second brush 22 and the drive motor 24 with the conductor 92.

In the idle state the first switch is open and/or makes the connection to a short-circuiting conductor 96, in order to hold the drive motor 24 in a braked condition. The switching circuit 84 is connected to the conductors 90 and 92 by a bridge rectifier 98.

The switching circuit 84 also forms a stopping circuit for the drive motor circuit and contains relay 94 connected by a Zener diode 100.

The Zener diode 100 is nonconductive when the voltage applied thereto is less than the voltage by which drive current is provided to the drive motor 24.

The relay 94 is activated only with a current having an associated voltage equal to that used for the drive current needed for the drive motor 24. Then the first switch $94_2$ can be closed and the drive motor 24 is again activated to drive the track-bound car 2. With a current having an associated voltage less than the voltage used to drive the drive motor 24, like that used for the unlocking process, the relay 94 remains idle (i.e. the drive current is cut off). Parallel to the Zener diode 100 and relay 94 an additional circuit 102 is present, in which the electromagnet 76 is connected and which is switched or activated by an additional second switch $94_1$ of the relay 94.

The second switch $94_1$ is closed in the idle state of the relay 94, so that current flows in the electromagnet 76, whereby the latch 50 is unlocked.

An additional electromagnet 76 of an additional unlocking mechanism for an additional latch can be provided parallel to electromagnet 76, as is indicated in FIG. 3 with dashed lines. The switching circuit 84 contains the additional circuit 102 and a time delay member 104, in order to prevent an activation of the electromagnet 76 during the short time during fall-off of the drive motor current.

FIG. 3 is a circuit diagram of the unlocking signal generator 86, which substantially comprises current source 106 with an unlocking voltage of 7 volts D.C. In the example shown the unlocking signal generator 86 includes a code reading device 38, which comprises reed switches 108, 110, and 112 connected in series, These reed switches 108, 110, and 112 are mounted rigidly in a specific code station. Each reed switch 108 or 110 or 112 responds to a code element 32 or 34 or 36, which is mounted on the track-bound car 2.

Only when the code elements 32, 34, and/or 36 are arranged in the code for that specific station can all three reed switches 108, 110, and 112 close and the unlocking signal generator 86 produce current for the current-carrying rails 16 and 18. For simpler applications the code reading device 38 can be omitted or deactivated, so that a permanent flow of current to the current-carrying rails 16 and 18 occurs. In this case the unlocking signal generator 86 can contain a switch, with which the unlocking signal generator 86 can be activated normally and/or by some other switching element, not shown.

Figure 4:
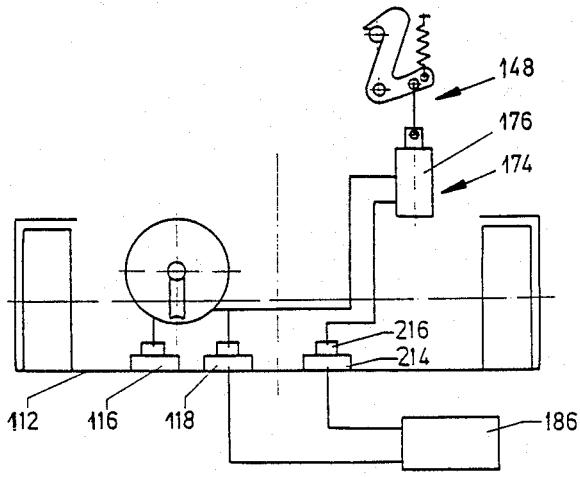
FIG. 4 is a schematic diagram showing how the unlocking mechanism is provided with a third rail in another embodiment of the conveyor according to my invention.

FIG. 4 shows part of another embodiment of the conveyor according to my invention. The control mechanism for the locking device 148 differs from that of the above embodiment. Here the tracks 112 as well as the current-carrying rails 116 and 118 have a third current-carrying rail 214 contacted by a third brush 216 of the track-bound car, which controls the unlocking mechanism 174. The unlocking signal generator 186 is connected with the third current-carrying rail 214 and one of the current-carrying rails 118, so that the corresponding switching circuit of this embodiment can be deactivated.

The locking mechanism described above can serve as the exclusive and single locking mechanism of the cover 4 or as an additional securing mechanism for an existing closing mechanism commonly used or for a closing mechanism as described in German Patent document DE-OS No. 34 11 143.

In contrast to the embodiment described above the locking mechanism for the drive current of the drive motor 24 cannot be a part of the switching circuit 84 of the unlocking mechanism, but instead can be a part of a switching circuit, which monitors the exact locking of the cover by means of a standard locking mechanism, as is described in Swiss Patents CH-PS Nos. 528 388 and 607 976. The first switch $94_2$ described in FIG. 3 can then be operated by a switching element of a circuit.

I claim:

1. In a conveyor comprising a track-bound car, a drive motor for displacing said track-bound car supplied with a drive current from a drive-current source having a voltage sufficient to drive said motor and connected to current-carrying rails along said track, and a container in said track-bound car closable by means of a cover, said car having current-takeoff means riding on said rails, said cover being lockable by means of a latch of a locking mechanism containing at least one electromagnet on said car, the improvement wherein an unlocking signal generator is positioned fixedly along said track, and at a position along said track for said track-bound car at which said container is to be unlocked, said unlocking signal generator having a voltage less than that of said source and insufficient to drive said motor in the absence of voltage from said source, connected electrically with to said rails, in order to supply an unlocking current to said locking mechanism for unlocking said container without driving said motor upon cutoff of said source.

2. The improvement according to claim 1 wherein two of said current-carrying rails are used to provide said drive current to said drive motor, and said track-bound car has two brushes for receiving said drive current.

3. The improvement according to claim 1 wherein a stop circuit is provided in a switching circuit of said drive motor, which prevents activation of said drive motor, if the voltage applied to said stop circuit is less than said voltage needed to produce said drive current.

4. The improvement according to claim 3 wherein said switching circuit comprises a bridge rectifier, and a relay in series with a Zener diode connected to said bridge rectified, wherein said Zener diode is nonconducting, if said voltage applied thereto is less than said voltage needed to produce said drive current, and said relay controls a second switch electrically connected with said unlocking mechanism.

5. The improvement according to claim 4 wherein said switching circuit includes a time delay unit, in order to prevent activation of said electromagnet in a short time during fall-off of said drive current.

6. The improvement according to claim 5 wherein, in said stop circuit for said drive motor said relay has a first switch, which disconnects said swtiching circuit from said drive motor.

7. The improvement according to claim 1 wherein said unlocking generator has a code reading device responding to a station specific code on said track-bound car.

8. The improvement according to claim 1 wherein said locking mechanism is automatically activated on closing said cover.

9. A conveyor comprising:

a plurality of stations, a track passing through each of said stations, a track-bound car movable between said plurality of stations, a drive motor for said track-bound car, at least one current-carrying rail mounted in the vicinity of said track to supply a drive current to said drive motor;

at least one brush mounted on said track-bound car and positioned to collect drive current from said current-carrying rail;

a container in said track bound car closable by a cover, a locking mechanism having an electromagnet in said track-bound car having a latch by which said cover is lockable, an unlocking mechanism for acting on said latch of said locking mechanism mounted in said track-bound car, at each of said stations an unlocking signal generator, which is to provide an unlocking current to said unlocking mechanism, when said track-bound car is at said station and said unlocking signal generator is connected electrically to said unlocking mechanism by said current-carrying rails for said drive motor, a switch circuit for said drive motor having a stop circuit, which prevents activation of said drive motor, when the voltage on said stop circuit is less than the voltage required to produce said drive current in said drive motor, and wherein said switching circuit comprises a bridge rectifier, a relay in series with a Zener diode connected to said bridge rectifier, and said Zener diode is nonconducting for a voltage applied thereto of less than said voltage needed to provide said drive current in said drive motor, and said relay controls a second switch electrically connected with said unlocking mechanism and a first switch, which disconnects said switching circuit from said drive motor.

10. A conveyor comprising:

a track defining a conveyor path;

at least one track-bound car on said track displaceable along said path, said car comprising:

a drive motor connected with wheels on said car for displacing same along said track, a container on said car, a cover on said car displaceable between an open position affording access to said container and a closed position preventing access to said container, and a locking mechanism on said car including at least one electromagnet and energizable to unlock said cover whereby said cover can be displaced from said closed position to said open position;

a plurality of current-carrying rails extending along said track, said car being formed with current-takeoff means connected to said motor and engaging said rails for drawing electric current from said rails;

a fixed source of electric current connected to said rails for supplying driving current to said motor and having a voltage sufficient to drive said motor through said current-takeoff means; and an unlocking signal generator fixedly positioned along said track externally of said car and connected to said rails for delivering thereto an unlocking current at a voltage less than the voltage of said source and insufficient to drive said motor and which is transmitted to said electromagnet through said current-takeoff means upon positioning of said car along said track at a station at which said cover is to be unlocked and disconnection of said source.

* * * * *